US012800241B2

(12) United States Patent
Kim et al.

(10) Patent No.: US 12,800,241 B2
(45) Date of Patent: Nov. 17, 2026

(54) HEAT SINK WITH MULTILAYER CHANNEL STRUCTURE

(71) Applicant: RESEARCH & BUSINESS FOUNDATION SUNGKYUNKWAN UNIVERSITY, Suwon-si (KR)

(72) Inventors: Sung-Min Kim, Suwon-si (KR); Hong-Cheol Shin, Suwon-si (KR); Hyeong-Geun Kim, Suwon-si (KR); Won-Woo Choi, Suwon-si (KR); Santhosh Senguttuvan, Suwon-si (KR)

(73) Assignee: RESEARCH & BUSINESS FOUNDATION SUNGKYUNKWAN UNIVERSITY, Suwon-si (KR)

( * ) Notice: Subject to any disclaimer, the term of this patent is extended or adjusted under 35 U.S.C. 154(b) by 133 days.

(21) Appl. No.: 18/441,112

(22) Filed: Feb. 14, 2024

(65) Prior Publication Data

US 2024/0288226 A1 Aug. 29, 2024

(30) Foreign Application Priority Data

Feb. 27, 2023 (KR) ..... 10-2023-0026108

(51) Int. Cl.
*F28F 3/12* (2006.01)
*F28F 3/08* (2006.01)
(Continued)

(52) U.S. Cl.
CPC ..... *F28F 3/086* (2013.01); *F28F 3/12* (2013.01); *F28F 9/0268* (2013.01); *F28F 9/005* (2013.01);
(Continued)

(58) Field of Classification Search
CPC .. H01L 23/4336; H01L 23/4735; F28F 3/086; F28F 3/12
See application file for complete search history.

(56) References Cited

U.S. PATENT DOCUMENTS 3,361,195 A * 1/1968 Motto, Jr. ..... H01L 23/4735 174/16.3
5,349,831 A * 9/1994 Daikoku ..... H01L 23/427 165/80.4
(Continued)

FOREIGN PATENT DOCUMENTS

CN 109524376 A * 3/2019 ..... H01L 23/4735
GB 2442978 A * 4/2008 ..... F28F 21/061
(Continued)

OTHER PUBLICATIONS

Translation of CN109524376A named Translation—CN109524376A (Year: 2018).*
(Continued)

*Primary Examiner* — Paul Alvare

(57) ABSTRACT

The present invention relates to a heat sink with a multilayer channel structure, the heat sink includes a main body part which is provided with an inlet through which a cooling fluid is introduced and an outlet through which the cooling fluid is discharged, a first channel part provided inside the main body part and through which the cooling fluid flows, and a second channel part which is provided inside the main body part and through which the cooling fluid flows, wherein the second channel part is disposed to be stacked on the first channel part, the first channel part and the second channel part extend in different directions, and the second channel part communicates with the first channel part.

18 Claims, 15 Drawing Sheets

(51) Int. Cl.
*F28F 9/02* (2006.01)
*F28F 9/00* (2006.01)

(52) U.S. Cl.
CPC ..... *F28F 2210/08* (2013.01); *F28F 2250/106* (2013.01)

(56) References Cited

U.S. PATENT DOCUMENTS

| | | | | |
|---|---|---|---|---|
| 2005/0143000 | A1* | 6/2005 | Eisele | F28F 13/02 257/E23.098 |
| 2007/0069432 | A1* | 3/2007 | Matich | B29C 51/26 264/553 |
| 2014/0190668 | A1* | 7/2014 | Joshi | H01L 23/4735 165/104.19 |
| 2020/0227341 | A1* | 7/2020 | Neal | F28F 3/12 |
| 2020/0258815 | A1* | 8/2020 | Suzuki | F28F 13/06 |
| 2020/0408466 | A1* | 12/2020 | Andrich | F28F 3/048 |

FOREIGN PATENT DOCUMENTS

| | | | |
|---|---|---|---|
| KR | 10-2018-0077461 | A | 7/2018 |
| KR | 10-2244964 | B1 | 4/2021 |
| KR | 10-2022-0133660 | A | 10/2022 |

OTHER PUBLICATIONS

Korean Office Action Issued on Jan. 24, 2025, in Counterpart Korean Patent Application No. 10-2023-0026108 (6 Pages in English, 6 Pages in Korean).

* cited by examiner

HEAT SINK WITH MULTILAYER CHANNEL STRUCTURE

CROSS-REFERENCE TO RELATED APPLICATION

This application claims priority to and the benefit of Korean Patent Application No. 10-2023-0026108, filed on Feb. 27, 2023, the disclosure of which is incorporated herein by reference in its entirety.

BACKGROUND

1. Field

The present invention relates to a heat sink with a multilayer channel structure, and more particularly, to a heat sink with a multilayer channel structure capable of cooling at a high heat flux by delaying a critical heat flux, which is a thermal limit of boiling heat transfer.

2. Discussion of Related Art

The conventional multi-port multi-channel heat sink has a problem in that heat transfer performance near an outlet of a channel is significantly reduced because the closer to the outlet of the channel, the more growth of a velocity/thermal boundary layer and vapor bubble layer. Further, the conventional composite jet impingement cooling technique has a problem in that a jet does not reach an impingement surface due to a strong cross-flow existing near an outlet of a channel, resulting in a rapid decrease in heat transfer performance.

The conventional single-phase heat transfer heat sink technology aims to maximize a heat transfer area by significantly increasing flow complexity, but the pressure drop between an inlet and an outlet increases, accompanied by a rapid increase in pumping power and a rapid decrease in cooling efficiency. In addition, in the conventional phase change heat transfer heat sink technology, a rapid decrease in heat transfer performance occurs when a surface is not rewet and dry-out occurs, which causes a rapid rise in temperature and permanent damage to electronic components and related equipment.

Therefore, the development of a new type of heat sink in which an increase in pressure drop is minimized while preventing a rapid decrease in heat transfer performance that occurs near an outlet of the heat sink is required.

The related art of the present invention is disclosed in Korean Patent Registration No. 10-2244964 (Published on Apr. 27, 2021, title of invention: Thermally Bonded Quartz Dome Heat Sink).

SUMMARY

The present invention is directed to providing a heat sink with a multilayer channel structure that is capable of suppressing the growth of a velocity/thermal boundary layer and vapor bubble layer that occurs along each channel by increasing a stagnation area and heat transfer area of jet impingement and increasing flow complexity.

According to an aspect of the present invention, there is provided a heat sink with a multilayer channel structure, which includes a main body part which is provided with an inlet through which a cooling fluid is introduced and an outlet through which the cooling fluid is discharged, a first channel part provided inside the main body part and through which the cooling fluid flows, and a second channel part which is provided inside the main body part and through which the cooling fluid flows, wherein the second channel part is disposed to be stacked on the first channel part, the first channel part and the second channel part extend in different directions, and the second channel part communicates with the first channel part.

The inlet may include a first inlet configured to guide the cooling fluid to the first channel part and a second inlet configured to guide the cooling fluid to the second channel part.

The first inlet and the second inlet may be formed to have different depths.

The first inlet and the second inlet may each be formed in at least one of a circular shape, an elliptical shape, and a polygonal shape.

The first inlet and the second inlet may each be formed in a shape of a long hole.

A long axis of the first inlet and a long axis of the second inlet may be disposed in different directions.

The first inlet and the second inlet may be formed to have different diameters.

The outlet may include a first outlet that communicates with the first channel part and a second outlet that communicates with the second channel part.

A cross section of the first channel part and a cross section of the second channel part may each be formed in at least one of a circular shape, an elliptical shape, and a polygonal shape.

The first channel part and the second channel part may be formed to have different heights.

The first channel part and the first outlet may be formed in the same shape.

The second channel part and the second outlet may be formed in the same shape.

The first channel part may be provided with a first impingement surface on which the cooling fluid introduced through the first inlet impinges.

The first impingement surface may be provided to face the first inlet.

The second channel part may be provided with a second impingement surface on which the cooling fluid introduced through the second inlet impinges.

The second impingement surface may be provided to face the second inlet.

An alternating flow part in which the cooling fluid flowing through the first channel part and the cooling fluid flowing through the second channel part alternately flow may be provided at an intersection part of the first channel part and the second channel part.

The heat sink may further include a heat spreader coupled to an outer surface of the main body part.

The main body part may be provided as a plurality of main body parts, and side surfaces of the plurality of main body parts may be disposed in contact with each other.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
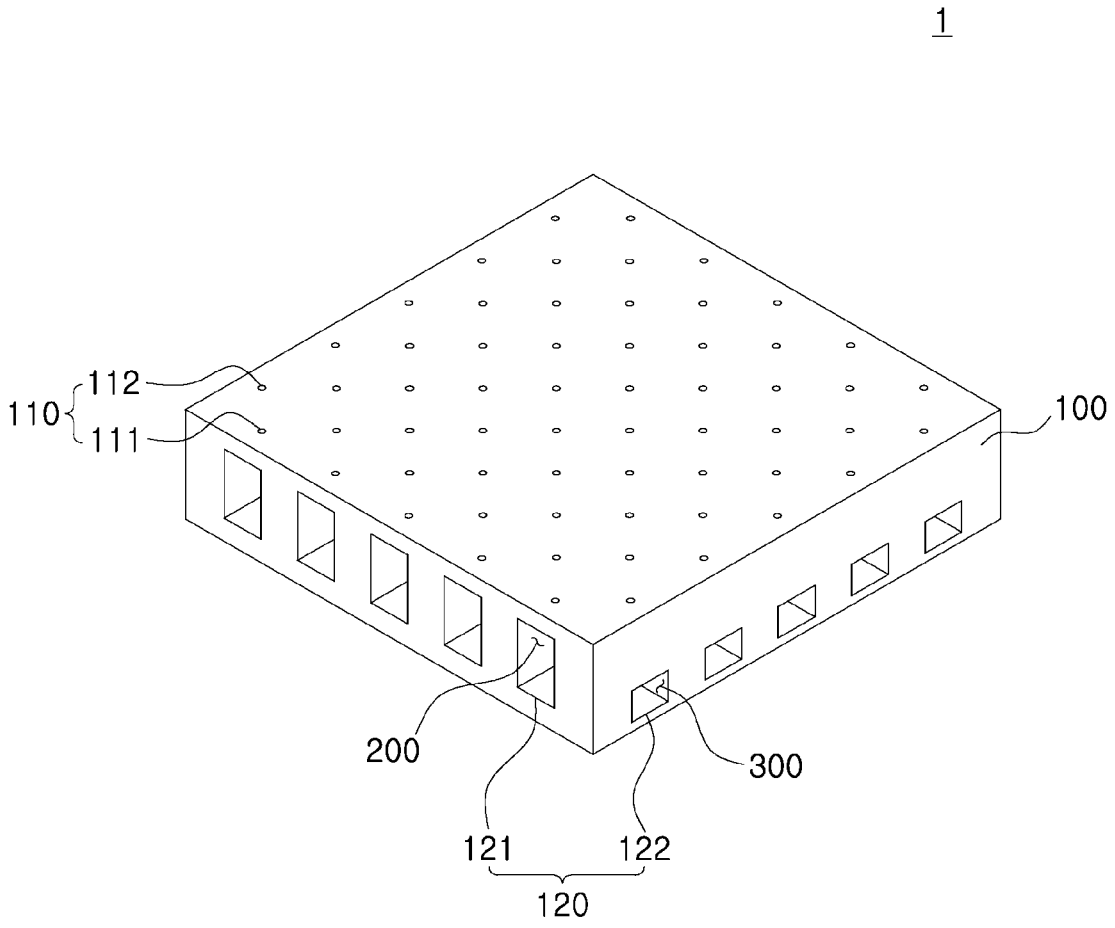
FIG. 1 is a perspective view illustrating a heat sink with a multilayer channel structure according to an embodiment of the present invention.

Hereinafter, embodiments of a heat sink with a multilayer channel structure according to the present invention will be described with reference to the accompanying drawings. In this process, thicknesses of lines, sizes of components, and the like illustrated in the drawings may be exaggerated for clarity and convenience of description. Further, some terms which will be described below are defined in consideration of functions in the present invention and meanings may vary depending on, for example, a user or operator's intentions or customs. Therefore, the meanings of these terms should be interpreted based on the scope throughout this specification.

Figure 2:
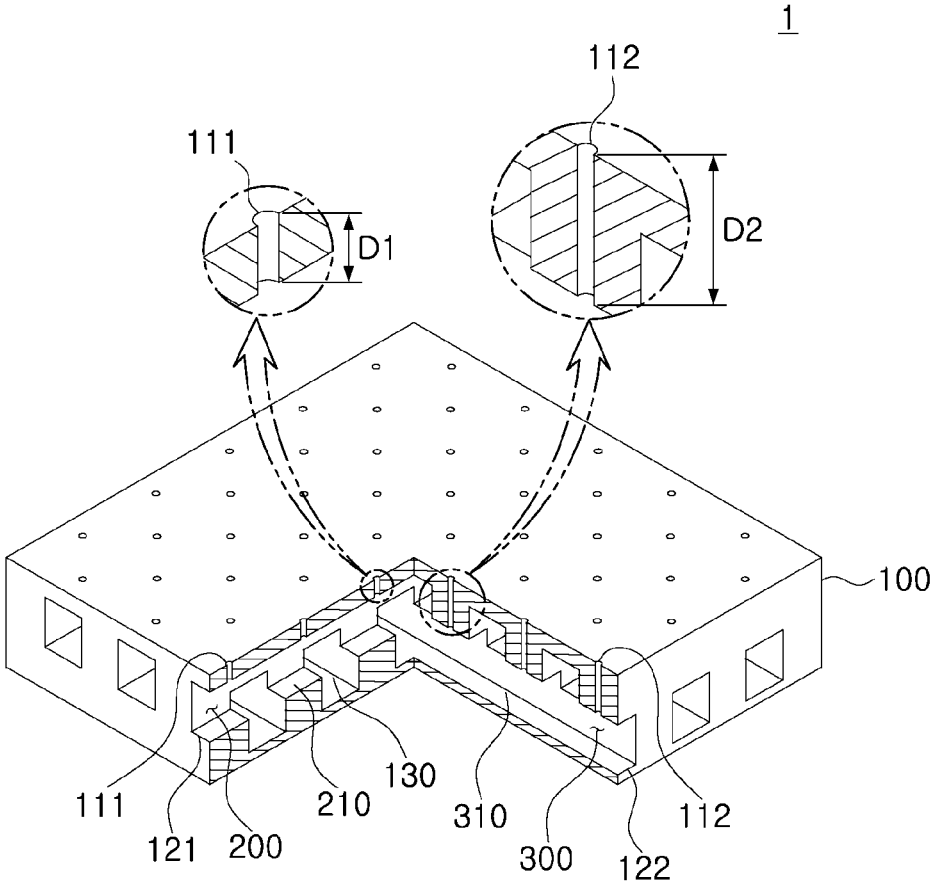
FIG. 2 is a partial cross-sectional perspective view illustrating an interior of the heat sink with the multilayer channel structure according to the embodiment of the present invention.
Figure 3:
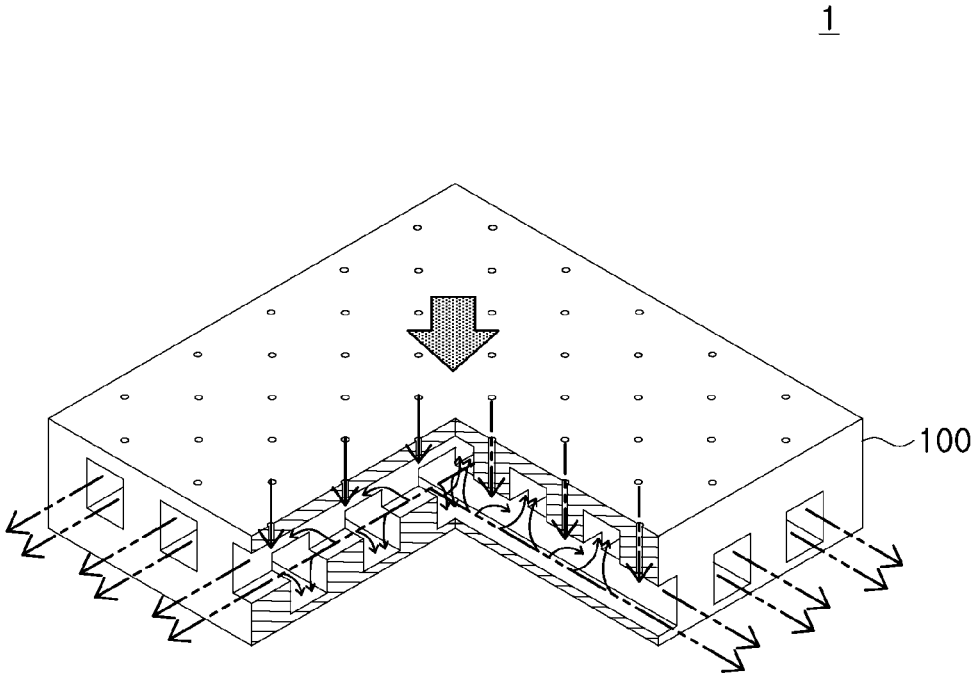
FIG. 3 is an exemplary diagram illustrating a flow state of a cooling fluid of FIG. 2.

FIG. 1 is a perspective view illustrating a heat sink with a multilayer channel structure according to an embodiment of the present invention, FIG. 2 is a partial cross-sectional perspective view illustrating an interior of the heat sink with the multilayer channel structure according to the embodiment of the present invention, FIG. 3 is an exemplary diagram illustrating a flow state of a cooling fluid of FIG. 2, FIGS. 4 to 8 are perspective views illustrating examples of a shape of an inlet in the heat sink with the multilayer channel structure according to the embodiment of the present invention, and FIGS. 9 to 12 are perspective views illustrating examples of a shape of an outlet and a shape of a channel part in the heat sink with the multilayer channel structure according to the embodiment of the present invention.

Referring to FIGS. 1 to 12, a heat sink 1 with a multilayer channel structure according to the embodiment of the present invention includes a main body part 100, first channel parts 200, and second channel parts 300, and will be described in detail as follows.

The main body part 100 includes inlets 110 and outlets 120. The inlets 110 are formed in an outer surface (upper surface in FIG. 1) of the main body part 100. The inlet 110 is formed in a shape of a hole, and the plurality of inlets 110 are disposed in the outer surface of the main body part 100 to be spaced apart from each other. A cooling fluid is introduced into the main body part 100 through the inlets 110.

A plenum chamber may be installed on an outer side (upper side in FIG. 1) of the main body part 100, and a pressure generating part, such as a fan, a pump, or the like, that increases an injection pressure of the cooling fluid may be located so that a high-pressure cooling fluid is injected toward the inlet 110.

The inlet 110 may include a first inlet 111 and a second inlet 112. The first inlet 111 guides the cooling fluid to the first channel part 200, which will be described below. Specifically, the first inlet 111 communicates with the first channel part 200. As the cooling fluid introduced through the first inlet 111 flows through the first channel part 200, internal cooling with high heat transfer performance occurs by the cooling fluid.

The second inlet 112 guides the cooling fluid to the second channel part 300. Specifically, the second inlet 112 communicates with the second channel part 300. As the cooling fluid introduced through the second inlet 112 flows through the second channel part 300, internal cooling with high heat transfer performance occurs by the cooling fluid.

Figure 4:
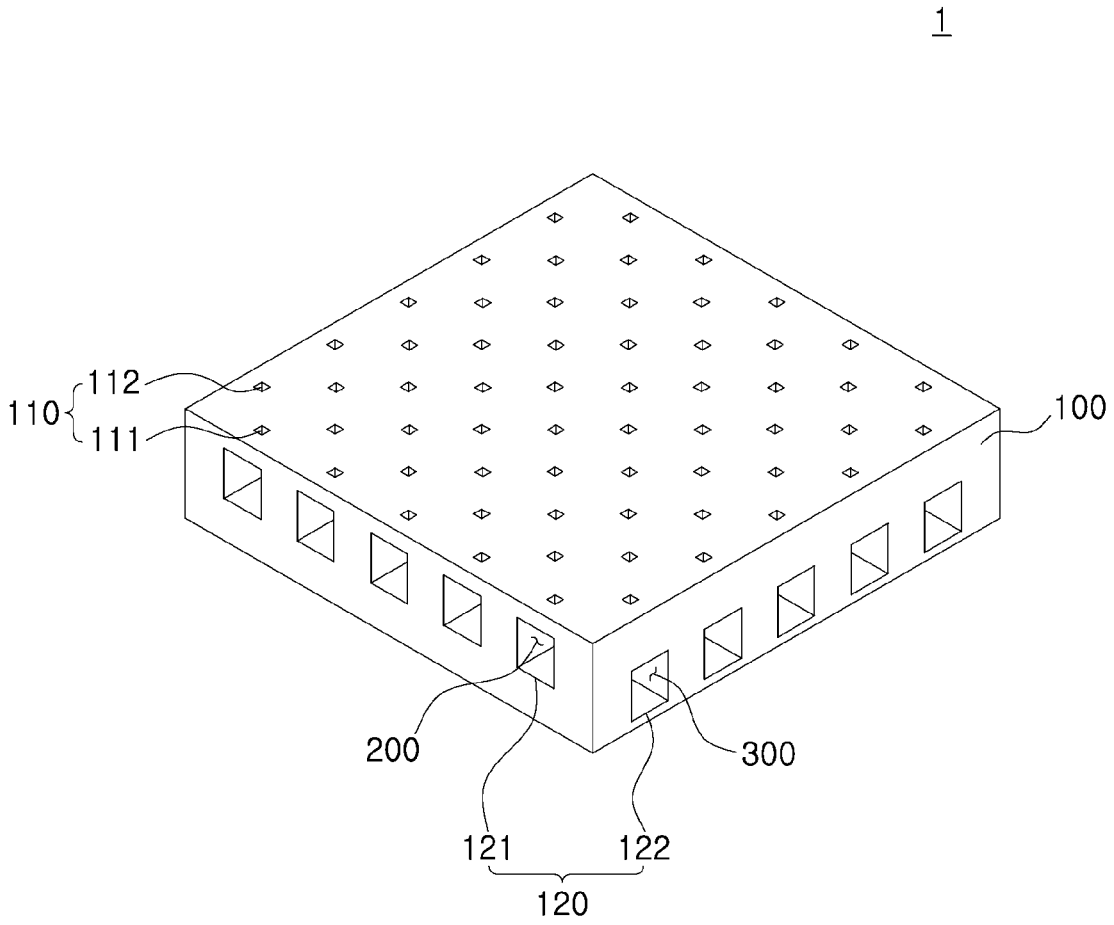
FIGS. 4 to 8 are perspective views illustrating examples of a shape of an inlet in the heat sink with the multilayer channel structure according to the embodiment of the present invention.

The first inlet 111 and the second inlet 112 may have a transverse section formed in at least one of a circular shape, an elliptical shape, and a polygonal shape. For example, as illustrated in FIG. 4, the first inlet 111 and the second inlet 112 may each be formed in a square shape. It is possible to optimize required cooling performance and improve the cooling performance by changing the shape of the inlet 110 through which the cooling fluid is introduced in consideration of the characteristics of the cooling environment and the cooling fluid.

Figure 5:
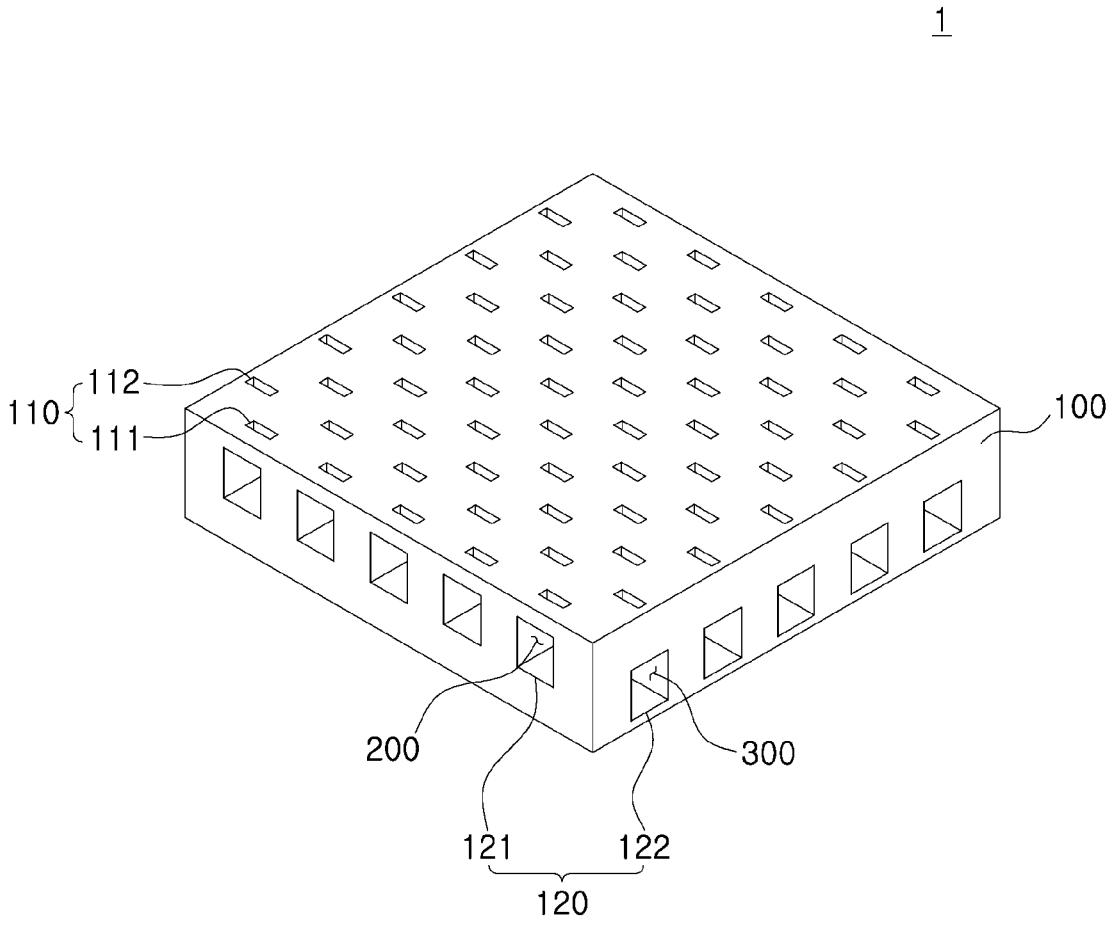
Figure 6:
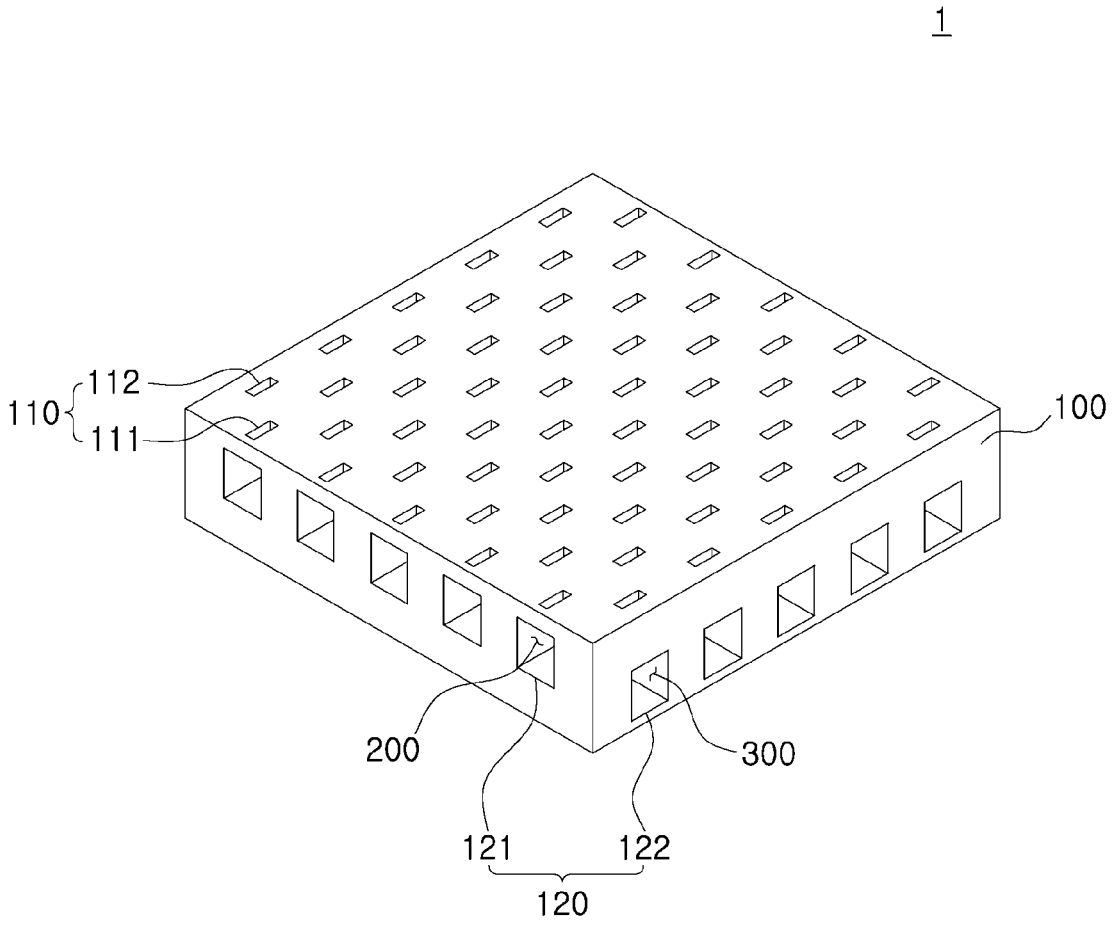
Figure 7:
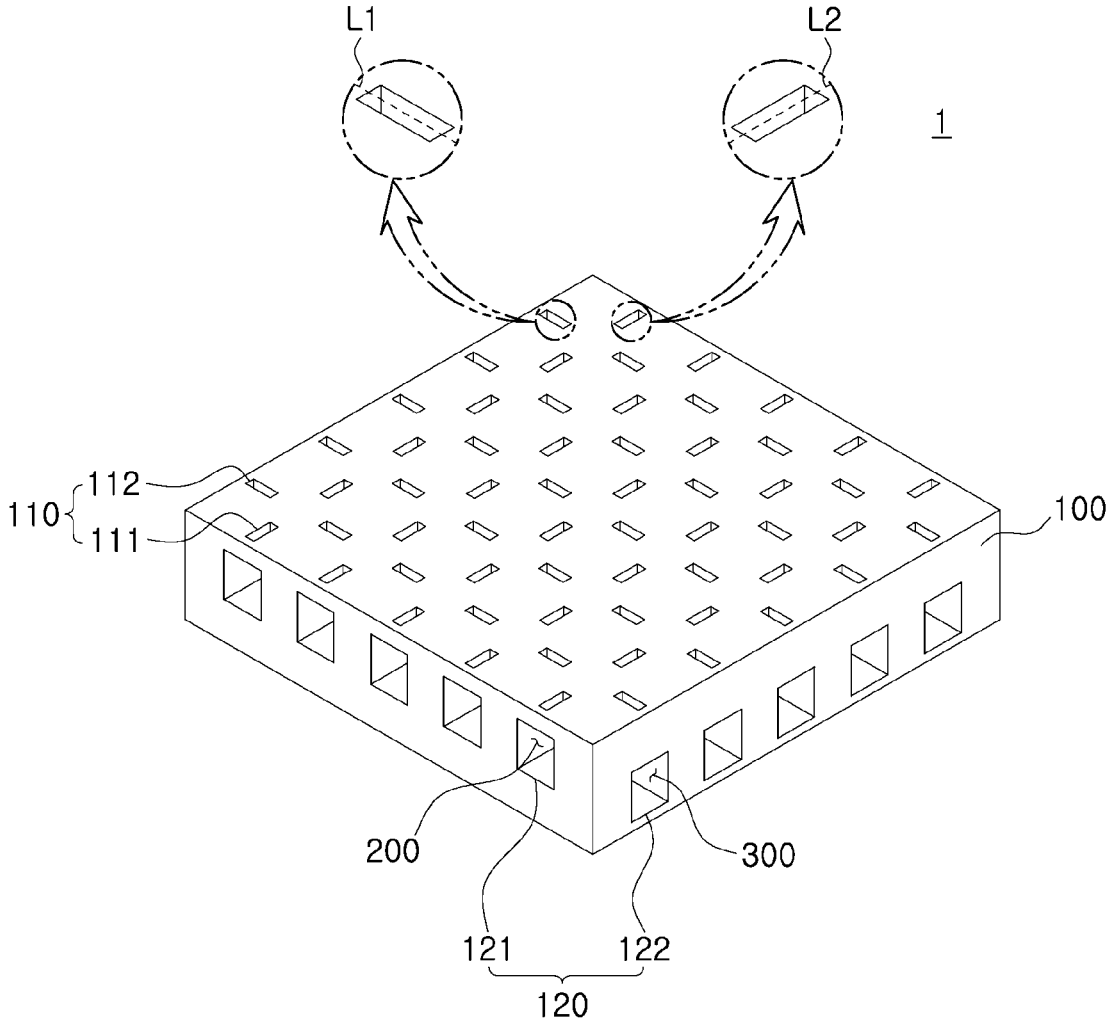

As illustrated in FIGS. 5 and 6, the first inlet 111 and the second inlet 112 may each be formed in a rectangular shape like a long hole. In this case, as illustrated in FIG. 7, a long axis L1 of the first inlet 111 and a long axis L2 of the second inlet 112 may be disposed in different directions. It is possible to optimize required cooling performance and improve the cooling performance by changing the shape of the inlet 110 through which the cooling fluid is introduced in consideration of the characteristics of the cooling environment and the cooling fluid.

Figure 8:
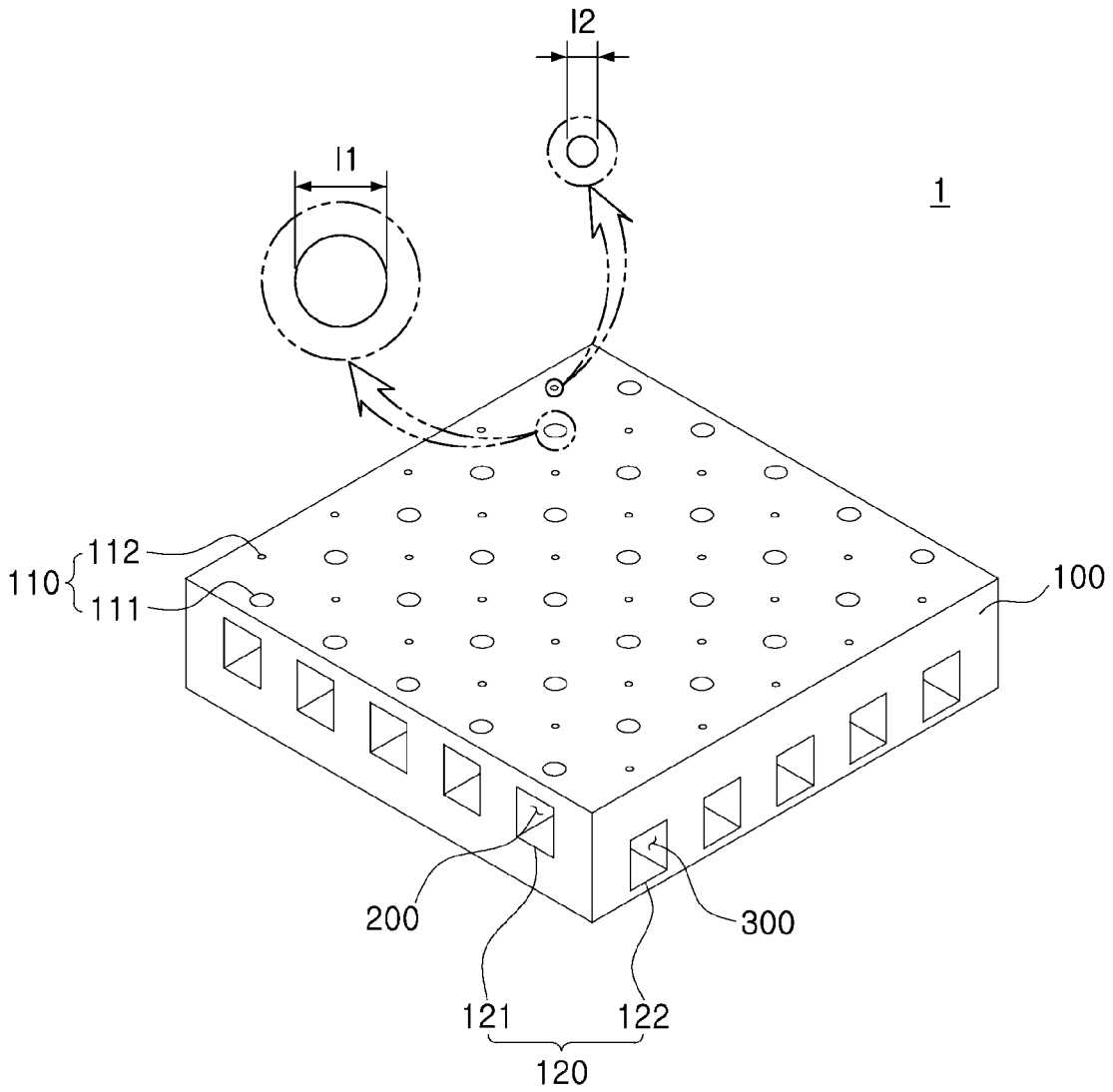

As illustrated in FIG. 8, the first inlet 111 and the second inlet 112 may be formed with different diameters. For example, a size of a diameter I1 of the first inlet 111 may be greater than a size of a diameter 12 of the second inlet 112. Of course, the size of the diameter 12 of the second inlet 112 may be greater than the size of the diameter I1 of the first inlet 111. It is possible to optimize required cooling performance and improve the cooling performance by changing the shape of the inlet 110 through which the cooling fluid is introduced in consideration of the characteristics of the cooling environment and the cooling fluid.

The outlets 120 are formed in outer surfaces of the main body part 100 (left and right surfaces in FIG. 1). The outlet 120 is formed in a shape of a hole. The cooling fluid introduced into the main body part 100 through the inlets 110 is discharged to the outside of the main body part 100 through the outlet 120.

The outlet 120 may include a first outlet 121 and a second outlet 122.

The first outlet 121 is formed on one outer surface (left surface in FIG. 1) of the main body part 100. The plurality of first outlets 121 may be disposed to be spaced apart from each other along the outer surface of the main body part 100. The first outlet 121 communicates with the first channel part 200. The cooling fluid flowing through the first channel part 200 may be discharged to the outside of the main body part 100 through the first outlets 121.

The second outlets 122 are formed in another outer surface (right surface in FIG. 1) of the main body part 100. The plurality of second outlets 122 may be disposed to be spaced apart from each other along the outer surface of the main body part 100. The second outlet 122 communicates with the second channel part 300. The cooling fluid flowing through the second channel part 300 may be discharged to the outside of the main body part 100 through the second outlet 122.

The first channel parts 200 are provided inside the main body part 100. Specifically, the first channel parts 200 are formed to pass through an interior of the main body part 100. The cooling fluid introduced through the inlet 110 flows through the first channel part 200 toward the outlet 120. In FIG. 3, flow directions of the cooling fluid are shown by arrows. In this case, the first channel part 200 may be formed to be orthogonal to the first inlet 111.

The first channel part 200 may be provided with a first impingement surface 210 on which the cooling fluid introduced through the first inlet 111 impinges. In this case, the first impingement surface 210 may be formed on an inner surface of the first channel part 200 to face the first inlet 111. Specifically, as a cooling fluid jet passing through the first inlet 111 jet-impinges with the first impingement surface 210, jet impingement cooling occurs within the first channel part 200.

The second channel part 300 is provided inside the main body part 100. Specifically, the second channel part 300 is formed to pass through the interior of the main body part 100. The cooling fluid introduced through the inlet 110 flows through the second channel part 300 toward the outlet 120. In FIG. 3, flow directions of the cooling fluid are shown by arrows. In this case, the second channel part 300 may be formed to be orthogonal to the second inlet 112.

The second channel part 300 may be provided with a second impingement surface 310 on which the cooling fluid introduced through the second inlet 112 impinges. In this case, the second impingement surface 310 may be formed on an inner surface of the second channel part 300 to face the second inlet 112. Specifically, as a cooling fluid jet passing through the second inlet 112 jet-impinges with the second impingement surface 310, jet impingement cooling occurs within the second channel part 300.

The first channel part 200 and the second channel part 300 are disposed to be stacked. For example, the first channel part 200 and the second channel part 300 may be located vertically. Therefore, as illustrated in FIG. 2, the first inlet 111 and the second inlet 112 is formed to have different depths. Specifically, a depth D2 of the second inlet 112 formed toward the second channel part 300 is greater than a depth D1 of the first inlet 111 formed toward the first channel part 200.

The first channel part 200 and the second channel part 300 extend in different directions. For example, the first channel part 200 and the second channel part 300 may be disposed to intersect with each other.

Figure 9:
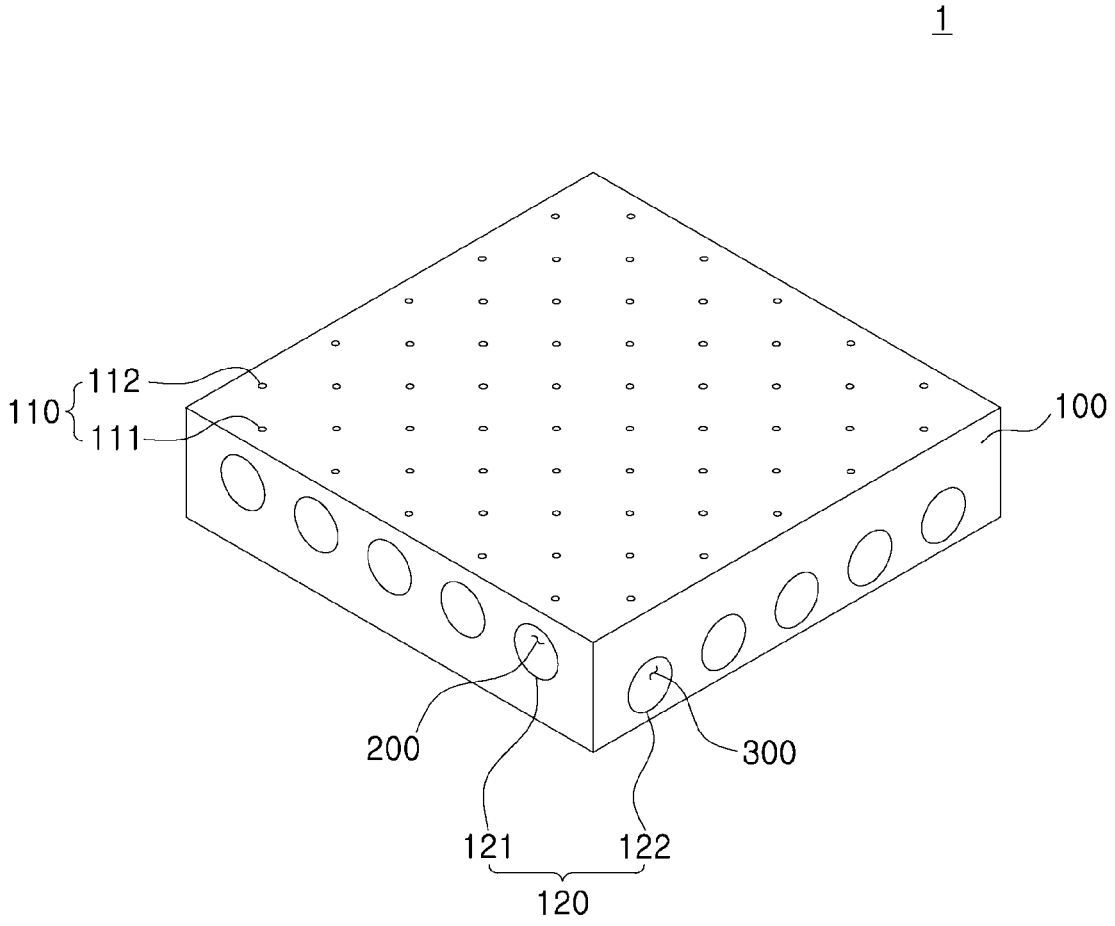
FIGS. 9 to 12 are perspective views illustrating examples of a shape of an outlet and a shape of a channel part in the heat sink with the multilayer channel structure according to the embodiment of the present invention.
Figure 10:
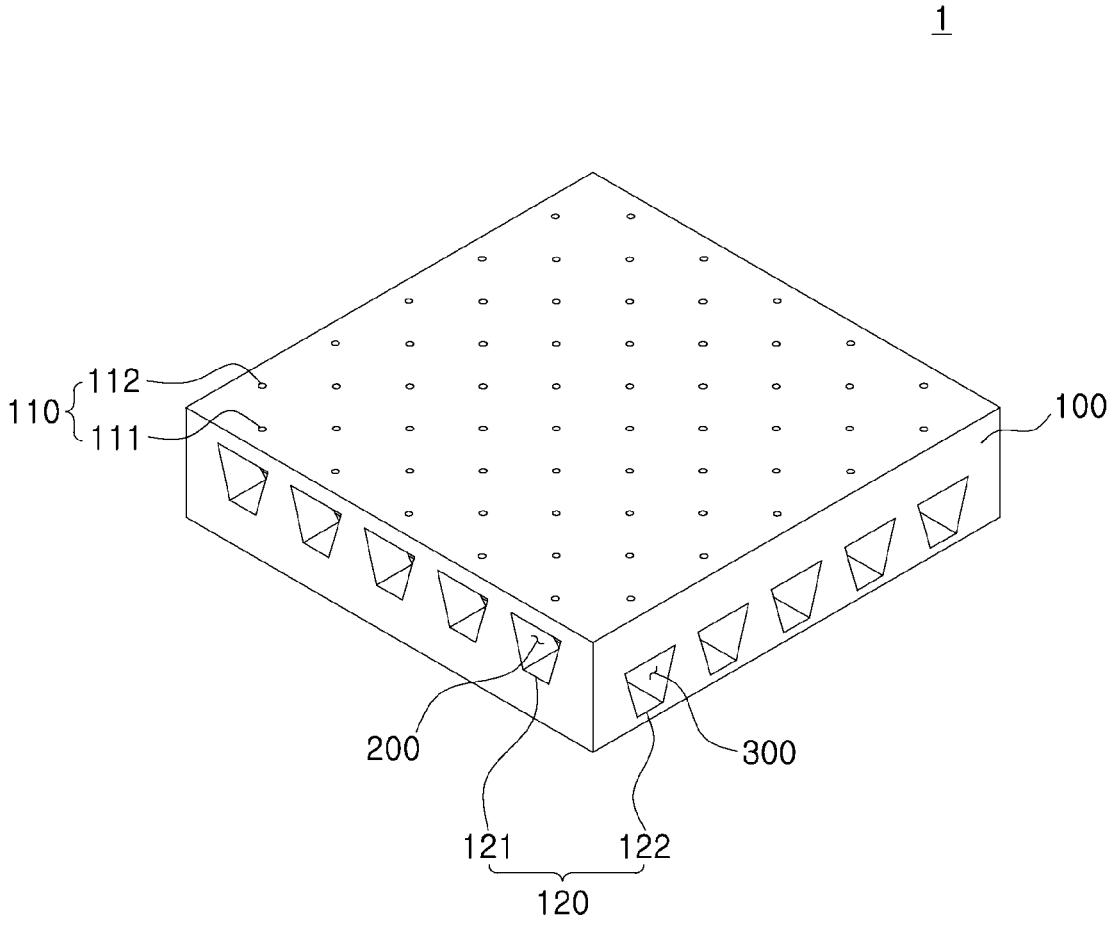

As illustrated in FIGS. 9 and 10, a cross section of the first channel part 200 and a cross section of the second channel part 300 may each be formed in at least one of a circular shape, an elliptical shape, and a polygonal shape. In this case, the first channel part 200 and the first outlet 121 may be formed in the same shape, and the second channel part 300 and the second outlet 122 may be formed in the same shape. It is possible to optimize required cooling performance and improve the cooling performance by changing the shapes of the channel parts 200 and 300 through which the cooling fluid is introduced in consideration of the characteristics of the cooling environment and the cooling fluid.

Figure 11:
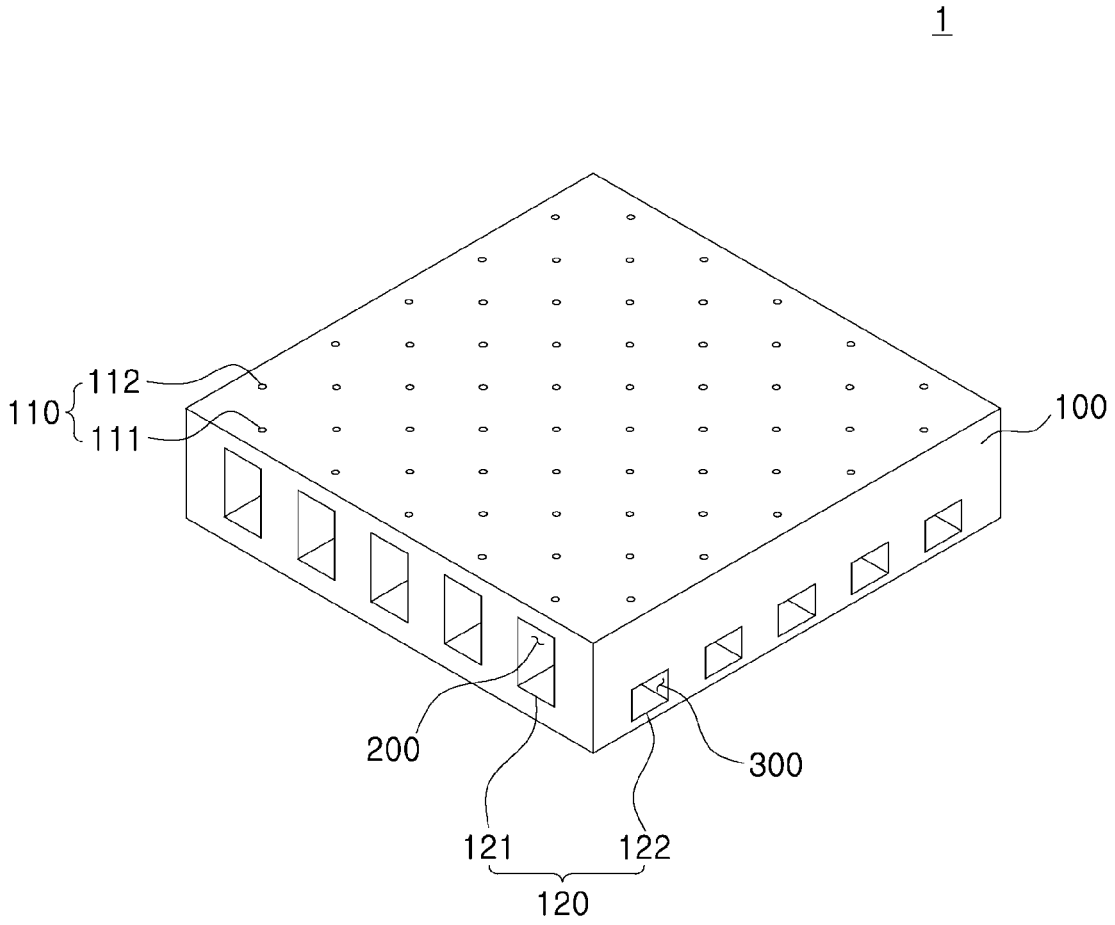
Figure 12:
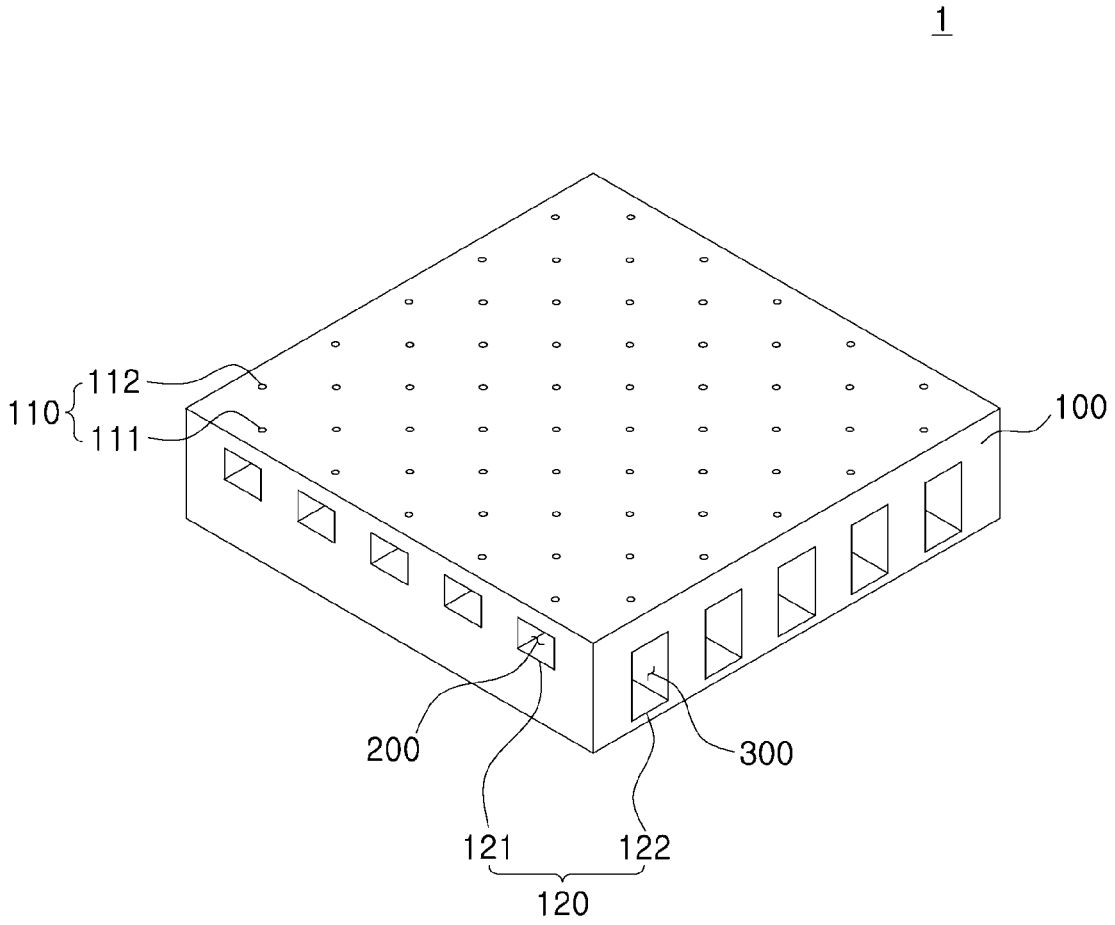

The first channel part 200 and the second channel part 300 may be formed to have different heights. As an example, as illustrated in FIG. 11, a height of a cross section of the first channel part 200 may be greater than a height of a cross section of the second channel part 300. As another example, as illustrated in FIG. 12, a height of a cross section of the second channel part 300 may be greater than a height of a cross section of the first channel part 200. It is possible to optimize required cooling performance and improve the cooling performance by changing the shapes of the channel parts 200 and 300 through which the cooling fluid is introduced in consideration of the characteristics of the cooling environment and the cooling fluid.

The first channel part 200 and the second channel part 300 communicate with each other. Specifically, the first channel part 200 and the second channel part 300 communicate with each other at an intersection part thereof. Therefore, the cooling fluid introduced through the first inlet 111 may flow through the first channel part 200 and the second channel part 300, and the cooling fluid introduced through the second inlet 112 may flow through the first channel part 200 and the second channel part 300.

Further, the cooling fluid flowing through the second channel part 300 may be discharged to the outside of the main body part 100 through the first outlet 121, and the cooling fluid flowing through the first channel part 200 may be discharged to the outside of the main body part 100 through the second outlet 122.

An alternating flow part 130 in which the cooling fluid flowing through the first channel part 200 and the cooling fluid flowing through the second channel part 300 alternately flow may be provided at the intersection part of the first channel part 200 and the second channel part 300. Specifically, the alternating flow between the first channel part 200 and the second channel part 300 occurs in the alternating flow part 130.

A heat sink 1 with a multilayer channel structure according to another embodiment of the present invention may further include a heat spreader 400.

Figure 13:
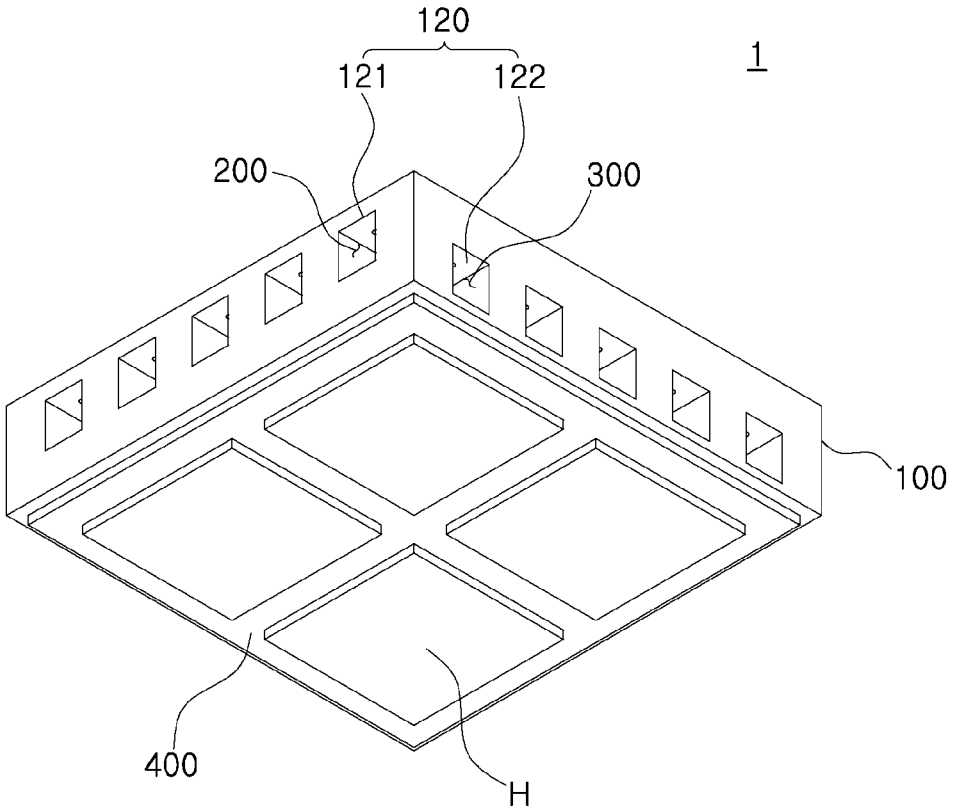
FIG. 13 is a perspective view illustrating a heat sink with a multilayer channel structure according to another embodiment of the present invention.

Referring to FIG. 13, the heat spreader 400 may be coupled to an outer surface (lower surface in FIG. 13) of the main body part 100. The heat spreader 400 is in contact with a heat source H such as an integrated circuit or the like, which is an electronic component, and transfers heat generated from the heat source H to the main body part 100.

Figure 14:
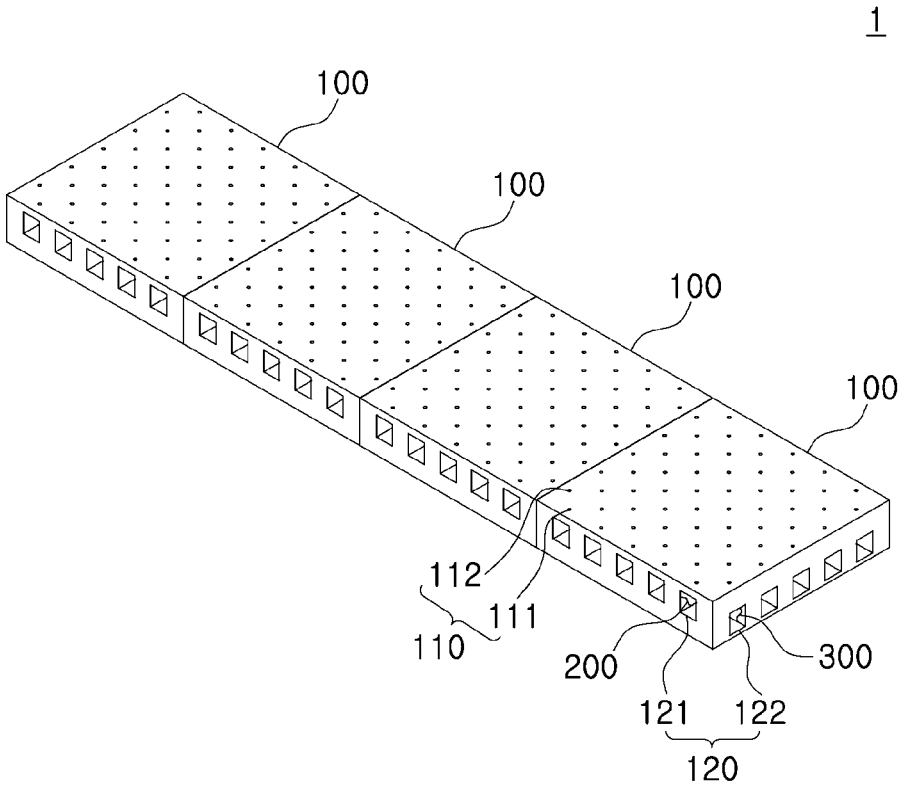
FIGS. 14 and 15 are perspective views illustrating a heat sink with a multilayer channel structure according to still another embodiment of the present invention.
Figure 15:
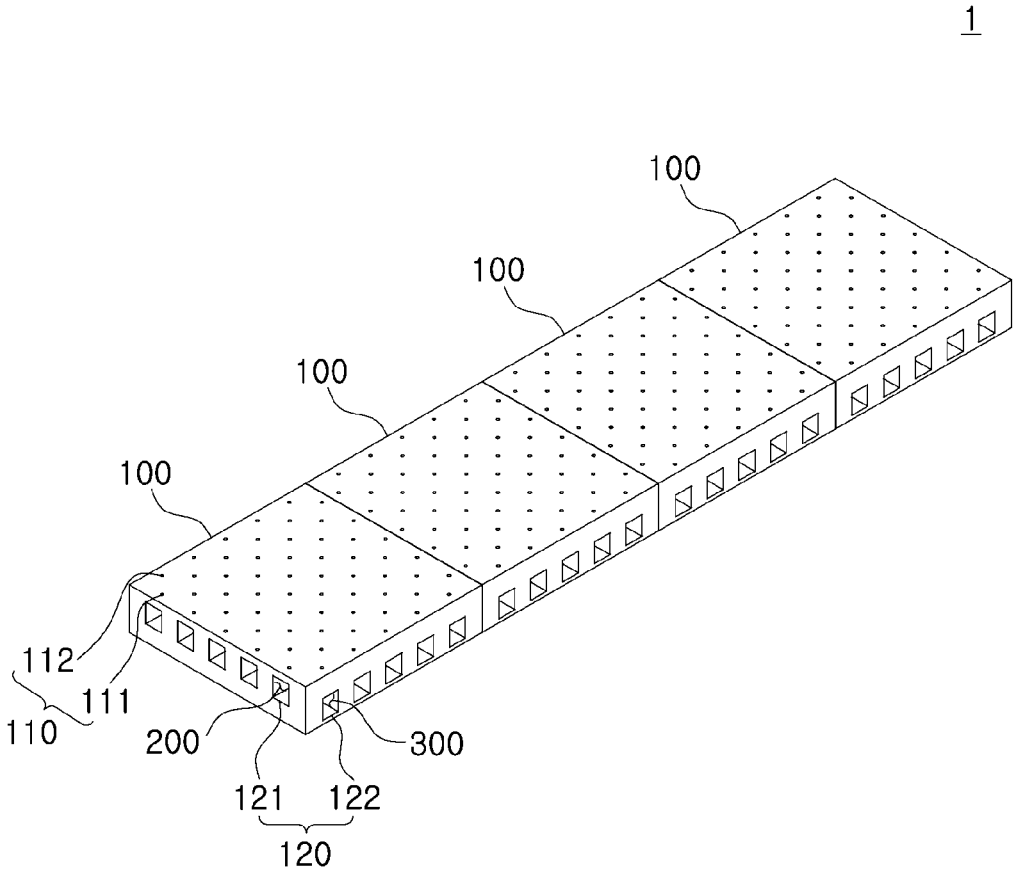

A heat sink 1 with a multilayer channel structure according to still another embodiment of the present invention may include a plurality of main body parts 100. Referring to FIGS. 14 and 15, the main body part 100 may be provided as a plurality of main body parts 100. Side surfaces of the plurality of main body parts 100 may be disposed in a row to be in contact with each other. A cooling area may be expanded through connection of units of heat sinks 1. Further, large-area cooling is possible through connection of the units of heat sinks 1.

In the heat sink 1 with the multilayer channel structure according to the embodiment of the present invention, the growth of a velocity/thermal boundary layer and vapor bubble layer that occurs along the first channel parts 200 and the second channel parts 300 may be suppressed by increasing a stagnation area and heat transfer area of jet impingement and increasing flow complexity, and thus, overheating of electronic components and related equipment that are becoming more integrated and miniaturized may be prevented.

Through complex jet impingement with the multilayer channel structure according to the embodiment of the present invention, the heat sink 1 may enable heat transfer performance and critical heat flux to be improved.

According to the present invention, the growth of a velocity/thermal boundary layer and vapor bubble layer that occurs along first channel parts and second channel parts can be suppressed by increasing a stagnation area and heat transfer area of jet impingement and increasing flow complexity, and thus overheating of electronic components and related equipment that are becoming more integrated and miniaturized can be prevented.

Further, according to the present invention, heat transfer performance and critical heat flux can be improved through complex jet impingement.

While the present invention has been described with reference to embodiments illustrated in the accompanying drawings, the embodiments should be considered in a descriptive sense only, and it should be understood by those skilled in the art that various alterations and equivalent other embodiments may be made. Therefore, the scope of the present invention should be defined by only the following claims.

What is claimed is:

1. A heat sink with a multilayer channel structure, comprising:

a main body part provided with an inlet through which a cooling fluid is introduced and an outlet through which the cooling fluid is discharged;

a first channel part which is provided inside the main body part and through which the cooling fluid flows; and a second channel part which is provided inside the main body part and through which the cooling fluid flows, wherein the second channel part is disposed to be stacked on the first channel part, the first channel part and the second channel part extend in different directions, and the second channel part communicates with the first channel part, wherein the inlet includes a first inlet configured to guide the cooling fluid to the first channel part, and a second inlet configured to guide the cooling fluid to the second channel part, wherein the first inlet and the second inlet are formed to have different depths, the second inlet having a greater depth than the first inlet to reach the second channel part disposed below the first channel part;

the first channel part is provided with a first impingement surface on which the cooling fluid introduced through the first inlet impinges, the first impingement surface facing the first inlet; and the second channel part is provided with a second impingement surface on which the cooling fluid introduced through the second inlet impinges, the second impingement surface facing the second inlet.

2. The heat sink of claim 1, wherein the first inlet and the second inlet are formed to have different depths.

3. The heat sink of claim 1, wherein the first inlet and the second inlet are each formed in at least one of a circular shape, an elliptical shape, and a polygonal shape.

4. The heat sink of claim 1, wherein the first inlet and the second inlet are each formed in a shape of a long hole.

5. The heat sink of claim 4, wherein a long axis of the first inlet and a long axis of the second inlet are disposed in different directions.

6. The heat sink of claim 1, wherein the first inlet and the second inlet are formed to have different diameters.

7. The heat sink of claim 1, wherein the outlet includes:

a first outlet that communicates with the first channel part; and a second outlet that communicates with the second channel part.

8. The heat sink of claim 7, wherein a cross section of the first channel part and a cross section of the second channel part are each formed in at least one of a circular shape, an elliptical shape, and a polygonal shape.

9. The heat sink of claim 7, wherein the first channel part and the second channel part are formed to have different heights.

10. The heat sink of claim 7, wherein the first channel part and the first outlet are formed in the same shape.

11. The heat sink of claim 7, wherein the second channel part and the second outlet are formed in the same shape.

12. The heat sink of claim 7, wherein the first channel part is provided with a first impingement surface on which the cooling fluid introduced through the first inlet impinges.

13. The heat sink of claim 12, wherein the first impingement surface is formed to face the first inlet.

14. The heat sink of claim 7, wherein the second channel part is provided with a second impingement surface on which the cooling fluid introduced through the second inlet impinges.

15. The heat sink of claim 14, wherein the second impingement surface is formed to face the second inlet.

16. The heat sink of claim 1, wherein an alternating flow part in which the cooling fluid flowing through the first channel part and the cooling fluid flowing through the second channel part alternately flow and interact with each other is provided at an intersection part of the first channel part and the second channel part.

17. The heat sink of claim 1, further comprising a heat spreader coupled to an outer surface of the main body part.

18. The heat sink of claim 1, wherein the main body part is provided as a plurality of main body parts, and side surfaces of the plurality of main body parts are disposed in contact with each other.

* * * * *